United States Patent [19]

Bachrich

[11] 4,014,107

[45] Mar. 29, 1977

[54] DRYING KILN FOR LUMBER

[76] Inventor: Jakob L. Bachrich, 3453 Wellington Cresent, North Vancouver, British Columbia, Canada, V7R 3B3

[22] Filed: Apr. 7, 1976

[21] Appl. No.: 674,518

[52] U.S. Cl. ..... 34/191; 34/196; 34/216; 34/225

[51] Int. Cl.[2] ..... F26B 21/06

[58] Field of Search ..... 34/105, 184–187, 34/191–197, 201, 216, 217, 218, 233, 236, 34, 22

[56] References Cited

UNITED STATES PATENTS

| | | | |
|---|---|---|---|
| 1,594,549 | 8/1926 | Noel | 34/196 |
| 3,149,932 | 9/1964 | Bachrich | 34/191 |
| 3,386,186 | 6/1968 | Tiefenbach | 34/191 |
| 3,659,352 | 5/1972 | Cook | 34/191 |

FOREIGN PATENTS OR APPLICATIONS

| | | | |
|---|---|---|---|
| 523,723 | 4/1921 | France | 34/196 |

*Primary Examiner*—Kenneth W. Sprague
*Assistant Examiner*—James C. Yeung
*Attorney, Agent, or Firm*—Townsend and Townsend

[57] ABSTRACT

A drying kiln for lumber. The kiln comprises a drying chamber having two spaced drying sections each to receive a stack of lumber. There is a second chamber above the drying chamber and drivable, reversible, circulating means in the second chamber. The kiln also has heating means for air circulated by the circulating means. A first passageway permits the circulating means to force heated air across the drying sections, across the space between them and back to the circulating means. A second passageway extends downwardly into the space between the dryer section. There is a first and a second closable inlet for the second passageway. Each inlet is positioned on a side of the circulating means to receive a proportion of air forced towards it by the circulating means. A plurality of outlets to said space are in said second passageway. Means control the first and second inlets whereby if one is open the other is closed.

10 Claims, 4 Drawing Figures

DRYING KILN FOR LUMBER

FIELD OF INVENTION

This invention relates to a drying kiln for lumber.

DESCRIPTION OF PRIOR ART

Lumber has been dried in kilns for some considerable time. Drying of the lumber in kilns is carried out in order to make the lumber available to the market in a shorter time than is possible using the older, natural drying.

Stated broadly, a drying kiln for lumber is a drying chamber of large volume that contains either means to heat the air within the building or means to introduce heated air into the chamber and circulating means—usually large diameter and relatively high speed fans—to circulate the air. The circulation of air may be longitudinal or may be lateral in the so-called cross flow kilns. The simpler kilns receive a single stack of lumber but it is clearly economically desirable that a kiln receives more than one stack of lumber. For this purpose double stack kilns have been evolved. However, there are problems with such kilns. An important problem, particularly with only one cross flow fan per unit length of kiln, is that across a given section the kiln air must penetrate both piles of lumber within the kiln before it returns to the fan and, more importantly, before venting of the used air takes place. Although it is a relatively simple matter to reheat the air between the piles by providing sources of heat between the piles of lumber it has not proved possible to dehumidify the air successfully in a cross flow filn having provision for double stacks of lumber but with one internal fan per unit length.

In my Canadian Pat. No. 699,870 issued on Dec. 15, 1964 I have described and claimed a system in which a drying kiln for lumber comprises a drying chamber including drying sections extending side by side and open to each other. Air circulating means in each section are arranged to move air transversely of its section in a direction opposite to that of the circulating means of the other section. The circulating means are arranged selectively to direct air towards and away from each other. There are baffle means for directing streams of air from both circulating means when the latter are directing air towards each other. The arrangement is such that the streams of air moving vertically between the stacks act as a curtain between the drying sections.

It will be appreciated that by this method air is provided to each stack of lumber without the necessity to reheat or to dehumidify air. The system of the patent may be described as a double stack drying kiln with single stack circulation but it should be noted that the system in the above Canadian patent requires a plurality of circulating means, generally fans, for each lumber stack.

SUMMARY OF THE INVENTION

The present invention provides a system in which a single circulating means, usually a fan, is provided for each unit length of the drying kiln.

Accordingly, in one aspect the present invention is a drying kiln for lumber comprising a drying chamber having two spaced drying sections each to receive a stack of lumber; a second chamber above the drying chamber; drivable, reversible, circulating means in the second chamber; heating means for air circulated by the circulating means; a first passageway permitting the circulating means to force heated air across the drying sections across the space between them and back to the circulating means; a second passageway extending downwardly into the space between the dryer sections; first and second inlets for the second passageway, each inlet positioned on a side of the circulating means to receive a proportion of air forced towards it by the circulating means; a plurality of outlets to said space in said second passageway; and means controlling the first and second inlets whereby if one is open the other is closed.

In a preferred embodiment the circulating means is a fan driven by an electric motor, or the fan can be mounted on a shaft. The shaft is supported by suitable bearings and extends through the kiln. The shaft can be driven by a motor situated externally to the kiln chamber. Usually, the circulating means will include a plurality of fans disposed along the length of the second chamber to force air in a direction laterally of the kiln, that is the flow is cross flow.

BRIEF DESCRIPTION OF DRAWINGS

An embodiment of the invention is illustrated in the accompanying drawings in which.

DESCRIPTION OF PREFERRED EMBODIMENTS

Figure 2:
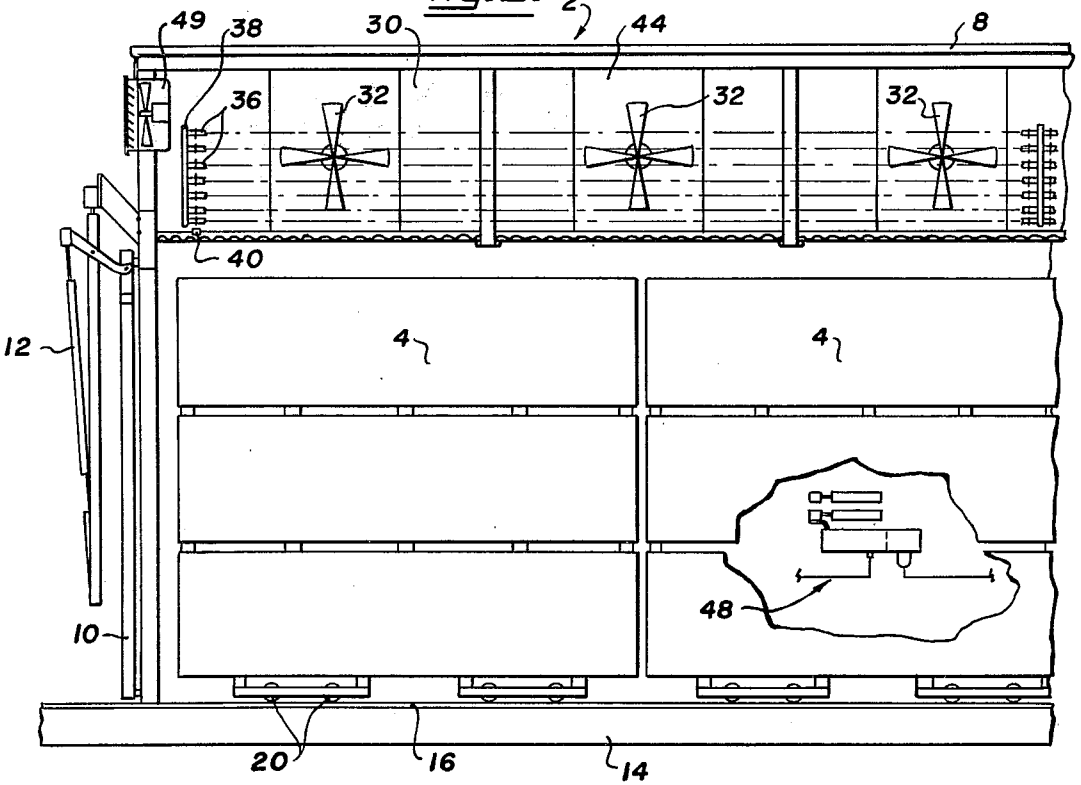
FIG. 2 is a partial side elevation of the drying kiln in FIG. 1.

The drawings illustrate a drying kiln generally indicated at 2 dimensioned to receive stacks of lumber 4 shown diagrammatically in the drawings. The kiln comprises walls 6, roof 8 and, as shown in FIG. 2, a door 10 provided with conventional hydraulic closing and lifting means 12. The floor 14 of the kiln is provided with tracks 16 on which run palettes 18 provided with wheels 20. The stacks of lumber 4 are mounted on the palettes 18.

The main portion of the kiln 2 is a drying chamber 22 defined by the walls 6, the base 4 and by a false ceiling 24. The drying chamber is divided into two spaced drying sections, 26 on the left of FIG. 1 and 28 on the right. It can be noted from FIG. 1 in particular that each drying section 26 and 28 is provided with a separate set of tracks 16. That is, one stack of lumber 4 can be introduced to each drying section 26 or 28.

Above the drying chamber 22 there is a second chamber 30 whose base is the false ceiling 24 of the drying chamber 22. Circulating means are positioned in the second chamber 30. In the illustrated embodiment the circulating means are a plurality of fans 32 disposed along the longitudinal axis of the second chamber 30. The fans 32 are driven by reversible electric motors 34.

Heating means are positioned in the second chamber 30. In the illustrated embodiment the heating means comprise finned steam tubes 36 which, as is conventional, are provided with condensate headers 38 (as shown in FIG. 2). A steam trap 40 is also provided in accordance with conventional practice. The use of steam heat is not, of course, essential to the invention.

Any means of heat known in the drying kiln art, particularly products of combustion, hot water or hot oil, may also be used.

The drying kiln 2 is provided with a first passageway that permits the fan 32 to force heated air across the drying sections 26 and 28 and across spaced 27 between the drying sections 26 and 28. The first passageway is formed by the false ceiling 24, by baffles 42 that are positioned at the ends of the false ceiling 24 to prevent air moving across the top of the lumber piles 4 and by baffles 44 that reflect the heated gas downwardly. One direction of air in the first passageway is indicated by the arrows with solid shafts shown in FIG. 1, the direction is, of course, reversed on reversal of the motors 34. It should be noted that in accordance with conventional practice humidity sprays 46 and wet bulbs-dry bulbs systems generally indicated at 48 are positioned within this first passageway so that the properties of the air, particularly with regard to its humidity, can be assessed and, if necessary, varied.

The kiln is also provided with power venting generally indicated at 49. Again such power venting is conventional in the drying kiln art. Its function is to evacuate humid, used air from the interior of the kiln 2 and, in particular, from the interior of the drying chamber 22.

Figure 1:
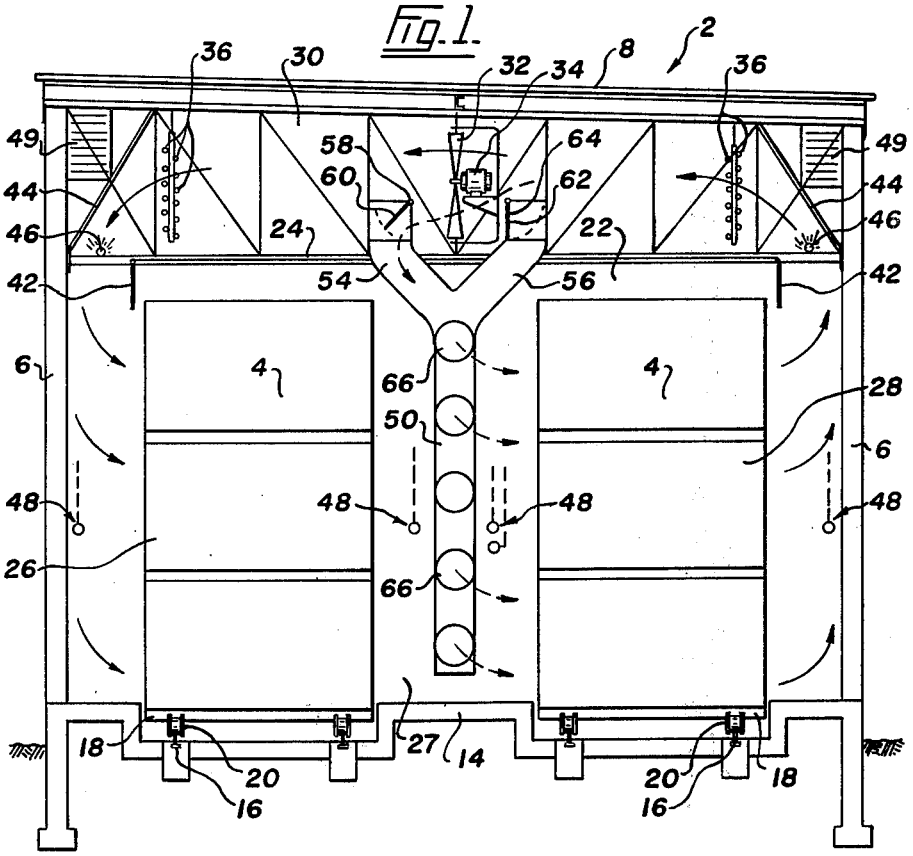
FIG. 1 is a section through a drying kiln according to the present invention.
Figure 3:
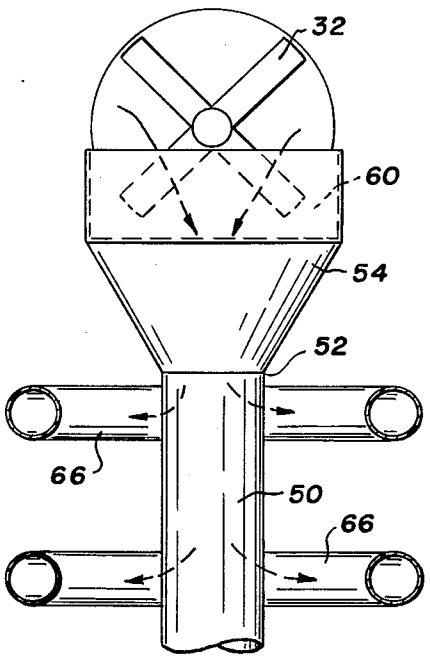
FIG. 3 illustrates a detail of the drying kiln of FIG. 1.

As illustrated particularly in FIGS. 1 and 3, a second passageway extends downwardly into the space 27 between the drying sections 26 and 28. As shown in FIGS. 1 and 3 the second passageway comprises a tubular ducting 50 that branches at 52 to form two branches 54 and 56. At the top of branch 54 there is an inlet 58 provided with a door 60. Branch 56 has an inlet 62 controlled by a door 64. The tubular duct 50 is provided with a plurality of outlets 66 so that air forced into the tubular duct 50 through inlets 58 or 62 may leave the duct 50 and enter the space 27 through outlets 66.

As indicated clearly in FIG. 1 the arrangement of the doors 60 and 64 is such that when one is open the other is closed. It should also be noted that the positioning of the inlets 58 and 62 is such that each receives a proportion of the air circulated in the first passageway by one of the fans 32.

Figure 4:
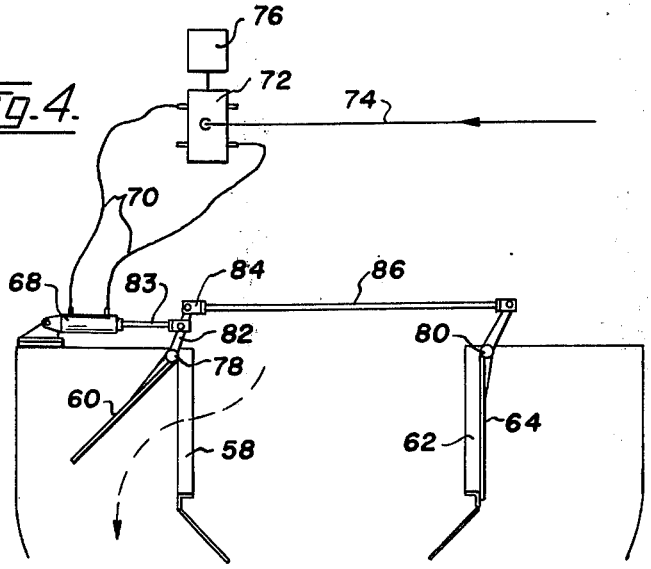
FIG. 4, which is on the first sheet of drawings, illustrates one aspect of the invention useful in the drying kiln of FIG. 1.

One means for controlling the first and second inlets to ensure that if one is opened the other is closed is illustrated in FIG. 4. The means comprises a double acting cylinder 68 having connecting pipes 70 so that air or hydraulic liquid may be fed to either side of the piston in the hydraulic cylinder 68. The pipes 70 are connected to a control valve 72 which is fed by air or hydraulic fluid through the pipe 74. The control valve 72 is attached to a timer 76 which is also used to time the rotations of the fan 32. That is the timer 76 insures that the fan drives in one direction for a predetermined time and then reverses to drive in the reverse direction, usually for the same predetermined time. Such an arrangement is well known for electric motors, for example, for electric motors driving fans.

Thus, the timer 76 in the embodiment illustrated in FIG. 4 ensures that air or hydraulic fluid is fed to the piston in the cylinder 68 to ensure that the door 60 or 64 towards which heated air is blown by the fan 32 will open and the other one will close. When the fan reverses direction under the influence of the timer 76 acting on the motor 34 then, simultaneously, the air or hydraulic fluid is fed to the cylinder 68 to reverse it from its previous direction and to ensure that the door 60 or 64 towards which the fan 32 is blowing air will open.

To ensure this, each door 60 and 64 is mounted on a pivot 78 and 80 respectively. Pivot 78 has a lever 82 extending from it to which is pivotally attached a rod 83 that is directly attached to the piston within the cylinder 68. A pivotal link 84 at the upper end of the lever 82, that is remote from the door 60, has attached to it a rod 86 that extends towards a corresponding system that is attached to the pivot 80 and, thus, to door 64. This system ensures that as door 60 is opened door 64 is closed and that as door 64 is opened door 60 closes.

It will be appreciated that a number of alternative systems can be used. In particular it is possible to replace the rod 86 by a chain that may engage sprockets mounted on a shaft upon which the doors 60 and 64 are also mounted. The actuation from the cylinder 68 is the same, that is a connecting rod extends from the piston within the cylinder to the shaft upon which the sprocket is mounted.

A further embodiment that is of use is where the fans are high-speed fans. In this embodiment it is simply necessary to provide each door 60 and 64 with a barometric control, that is a control responsive to pressure. Thus, as the pressure on a door is increased by the fan 32 directing air onto it that door opens. Similarly as the pressure on a door 60 or 64 is decreased by a reversal in direction of the fan then the barometric control closes that door.

The man skilled in the art will appreciate that the present invention provides a means of introducing fresh, heated air that is not humidified, to each stack of lumber 4 even though the kiln according to the present invention is able to receive two stacks of lumber. The air introduced into the space 27 between the stacks 26 and 28 is forced through the lumber by the direction of air within the first passageway.

The kiln according to the present invention may be manufactured in a manner analogous to the prior art kilns. For example, the electric motor preferably has class H insulation. The kiln may be provided with the trusses common in such kilns. The door is conventional. A desirable door is an aluminum with fiberglass filling. Again as is conventional, door seal strips are desirably provided.

The false ceiling 24 may be a corrugated aluminum deck. The fans 32 are desirably of aluminum alloy.

Electric motor 34 may be replaced by hydraulic motors.

It will be appreciated that the kiln of the present invention is a true cross circulation kiln in which excellent air supply is provided to each stack of lumber within the kiln and in which heated air to dry the lumber is provided to the second stack without first having to pass through the first stack. This desirable feature is achieved by the use of one cross circulation fan per unit of length of the kiln. Generally speaking the drying kiln of the invention is conventional in dimensions. A typical embodiment will be 32 feet wide, 22 feet high and 64 to 128 feet long.

I claim:

1. A drying kiln for lumber comprising a drying chamber having two spaced drying sections each to receive a stack of lumber;

a second chamber above the drying chamber;

drivable, reversible, circulating means in the second chamber;

heating means for air circulated by the circulating means;

a first passageway permitting the circulating means to force heated air across the drying sections, across the space between them and back to the circulating means;

a second passageway extending downwardly into the space between the dryer sections;

a first and second closable inlet for the second passageway, each inlet positioned on a side of the circulating means to receive a proportion of air forced towards it by the circulating means;

a plurality of outlets to said space in said second passageway; and means controlling the first and second inlets whereby if one is open the other is closed.

2. A drying kiln as claimed in claim 1 in which the circulating means is a fan driven by an electric motor.

3. A drying kiln as claimed in claim 1 in which the heating means is a heat exchanger positioned in the first passageway, one on each side of the circulating means.

4. A drying kiln as claimed in claim 1 in which the second passageway is formed of ducting having upper ends defining the first and second inlets, each inlet closable by a door, the ducting joining in a pipe that extends into the space between the drying sections.

5. A drying kiln as claimed in claim 4 in which the outlets to the space are defined by branch pipes extending from the downwardly extending pipe.

6. A drying kiln as claimed in claim 1 in which the circulating means are high velocity fans and the means controlling the first and second inlets comprises, barometric doors, one to each inlet, openable by pressure applied on the side of the door adjacent the fan.

7. A drying kiln as claimed in claim 1 in which the means controlling the first and second inlets is a mechanical linkage by a reciprocable piston so that it the means controlling the inlets may be moved to a desired position, closed or open.

8. A drying kiln as claimed in claim 7 in which the circulating means is provided with a timer whereby its direction of circulation is varied at predetermined intervals.

9. A drying kiln as claimed in claim 8 in which the linkage of the first and second inlets is also controlled by the timer so that as the fan reverses the means controlling the inlets change their positions.

10. A drying kiln as claimed in claim 9 in which the piston is operated pneumatically or hydraulically.

* * * * *